US006651362B2

(12) United States Patent
Caveney

(10) Patent No.: US 6,651,362 B2
(45) Date of Patent: Nov. 25, 2003

(54) CABLE IDENTIFICATION SYSTEM

(75) Inventor: Jack E. Caveney, Hinsdale, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 10/285,713

(22) Filed: Nov. 1, 2002

(65) Prior Publication Data

US 2003/0089005 A1 May 15, 2003

Related U.S. Application Data

(60) Provisional application No. 60/335,966, filed on Nov. 14, 2001.

(51) Int. Cl.[7] ..... G09F 3/00
(52) U.S. Cl. ..... 40/316; 40/638
(58) Field of Search ..... 40/316, 636, 666, 40/660, 638

(56) References Cited

U.S. PATENT DOCUMENTS

| | | | | | |
|---|---|---|---|---|---|
| 1,463,755 | A | * | 7/1923 | West | 40/660 |
| 2,818,168 | A | | 12/1957 | Tobey et al. | |
| 2,914,166 | A | * | 11/1959 | Bihler | 40/316 |
| 3,068,600 | A | | 12/1962 | Blanchet | |
| 3,263,948 | A | | 8/1966 | Conrad | |
| 4,268,986 | A | | 5/1981 | Piana | |
| 4,465,717 | A | | 8/1984 | Crofts et al. | |
| 4,579,759 | A | * | 4/1986 | Breuers | 40/316 |
| 4,609,208 | A | * | 9/1986 | Wrobel | 40/316 |
| 4,636,271 | A | * | 1/1987 | Gandolfo | 40/316 |
| 4,656,767 | A | | 4/1987 | Tarrant | |
| 4,876,810 | A | * | 10/1989 | Piana et al. | 40/316 |
| 4,899,474 | A | | 2/1990 | Piana et al. | |
| 4,947,568 | A | | 8/1990 | De Barbieri | |
| 4,951,596 | A | | 8/1990 | Wallace, Jr. | |
| 5,111,605 | A | | 5/1992 | Bossi | |
| 5,115,586 | A | * | 5/1992 | Hawker | 40/316 |
| 5,157,853 | A | | 10/1992 | Piana et al. | |
| 5,187,854 | A | | 2/1993 | Bossi | |
| 5,195,783 | A | | 3/1993 | Lavoie | |
| 5,275,282 | A | | 1/1994 | Ross et al. | |
| 5,366,575 | A | | 11/1994 | Staff et al. | |
| D388,833 | S | | 1/1998 | Wilson | |
| 5,974,708 | A | * | 11/1999 | Webb et al. | 40/316 |
| 6,073,377 | A | * | 6/2000 | Mehta | 40/638 |

* cited by examiner

*Primary Examiner*—Gary Hoge
(74) *Attorney, Agent, or Firm*—Robert A. McCann; Jay A. Saltzman; Christopher S. Clancy

(57) ABSTRACT

A cable identification system includes a split sleeve label spacer positionable substantially circumferentially around a cable, and an adhesive label securable circumferentially around the label spacer. A method of securing identifying indicia to small diameter fiber optic cables is also disclosed.

9 Claims, 2 Drawing Sheets

CABLE IDENTIFICATION SYSTEM

CROSS-REFERENCE TO RELATED APPLICATIONS

This application claims priority to U.S. Provisional Application Ser. No. 60/335,966, filed on Nov. 14, 2001, the entirety of which is hereby incorporated by reference.

BACKGROUND OF THE INVENTION

The present invention is directed to the identification of cables and wires, and more particularly, to an identification system for easily and properly securing identifying indicia to small diameter fiber optic cables.

A variety of methods of identifying wires and cables are known in the art. Existing methods for identifying wires and cables include self-laminated adhesive labels, tape markers, clip-on wire markers and slip-on wire markers. See, for example, U.S. Pat. Nos. 4,268,986, 4,579,759, 4,899,474, and 4,947,568. Various disadvantages still exist in prior cable identification methods, especially in applications utilizing small diameter fiber optic cables which can be easily damaged. For example, self-laminated adhesive labels are difficult to apply to small diameter fiber optic cables and the surface area provided to properly identify and include sufficient information is a drawback. Also, sleeve-type marker clips can only be installed prior to termination of both ends of a fiber optic cable, and they can also cause damage to the cable if they are crimped in a fixed position on the cable. Moreover, clip-on markers either are designed to be fixedly secured to a fiber optic cable and, thus, are likely to damage the cable upon application, or the markers are so loosely applied to the cable that the identifying indicia is not in a fixed position along the cable.

It would be desirable to provide a cable identification system that allows identifying indicia to be applied to small diameter fiber optic cables without damaging the cables.

It would also be desirable to provide a cable identification system that easily and properly secures identifying indicia to small diameter fiber optic cables, while still allowing the identifying indicia to be readily viewable.

It would further be desirable to provide a cable identification system that affixes identifying indicia in a substantially permanent manner in a specific location along small diameter fiber optic cables.

SUMMARY OF THE INVENTION

A cable identification system is disclosed. The cable identification system includes a split sleeve label spacer positionable substantially circumferentially around a cable, and an adhesive label securable circumferentially around the label spacer.

Preferably, the label spacer has two opposed arms capable of moving from a first, non-compressed position to a second, compressed position, upon securing the adhesive label circumferentially around the label spacer. Moreover, an opening connects the two opposed arms, and the opening allows engagement of the cable in the first position.

Preferably, the cable identification system includes a pressure sensitive adhesive appliable to an interior circumferential surface of the label spacer to prevent the label spacer from sliding along the cable.

Preferably, the label spacer is C-shaped and made of plastic.

Preferably, the cable is a two or three millimeter fiber optic cable.

DETAILED DESCRIPTION OF THE PREFERRED EMBODIMENT

The illustrated embodiments of the invention are directed to an identification system for easily and properly securing identifying indicia to small diameter fiber optic cables.

Figure 1:
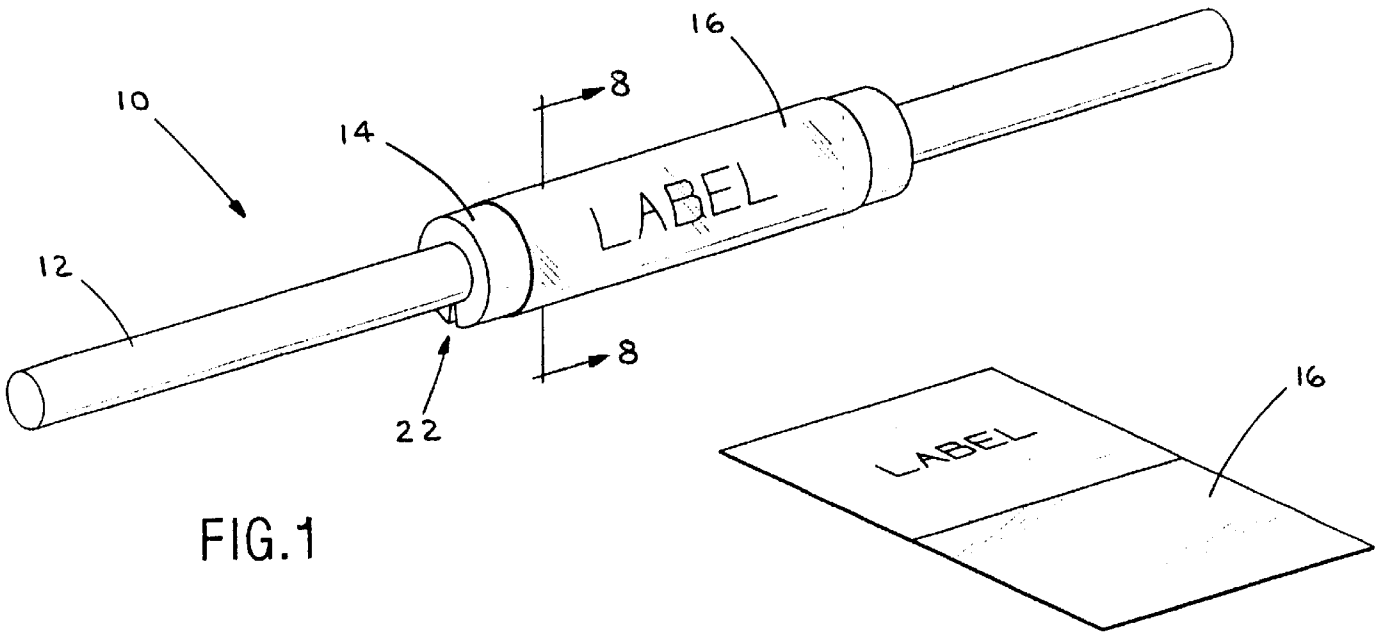
FIG. 1 is a front perspective view of a cable identification system according to the present invention.

FIG. 1 shows a perspective view of a cable identification system 10 for securing identifying indicia to small diameter fiber optic cables, such as cable 12. Preferably, cable identification system 10 is secured to two millimeter or three millimeter fiber optic cables. However, it is likewise contemplated that cable identification system 10 may be secured to fiber optic cables of various sizes.

Figure 2:
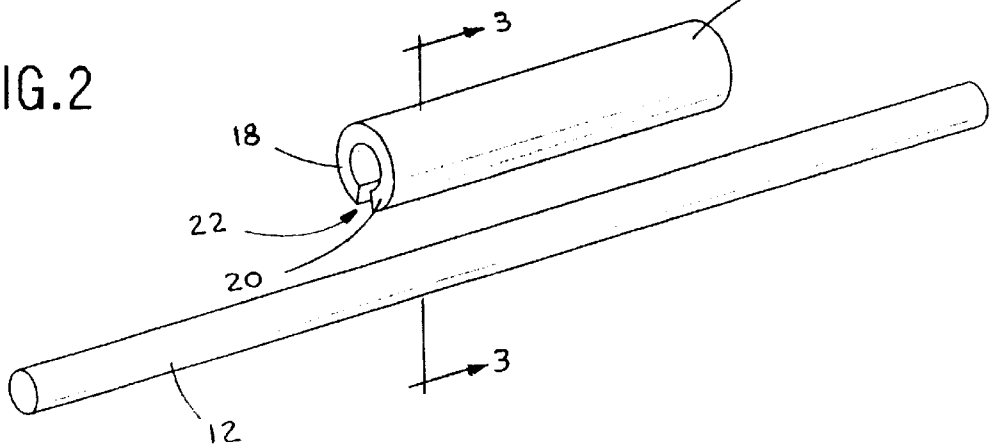
FIG. 2 is an exploded perspective view of the cable identification system of FIG. 1.

As shown in FIG. 2, cable identification system 10 includes split sleeve label spacer 14 and adhesive label 16. Preferably, label spacer 14 is C-shaped and made of plastic. However, it is likewise contemplated that label spacer 14 may be of various shapes and made of various materials. Moreover, adhesive label 16 is a self-laminating vinyl label. However, it is likewise contemplated that adhesive label 16 may be a variety of types and of different shapes and sizes.

Figure 3:
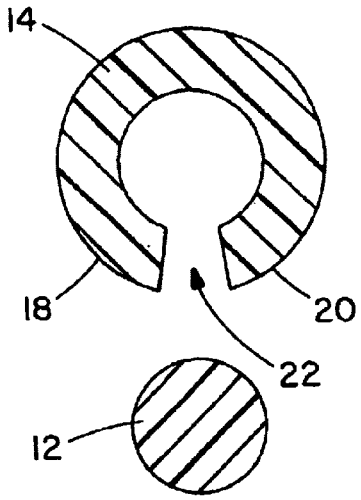
FIG. 3 is a cross-sectional view taken along lines 3—3 of FIG. 2, prior to positioning of the label spacer around the cable.
Figure 4:
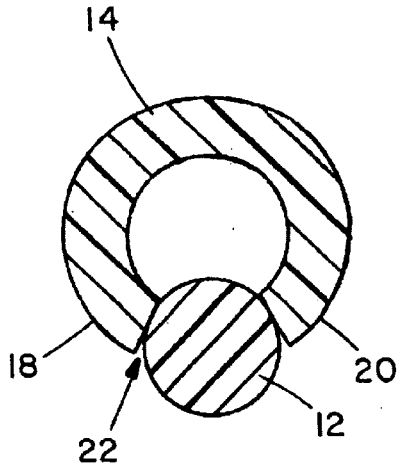
FIG. 4 is a cross-sectional view similar to FIG. 3, during positioning of the label spacer around the cable.
Figure 5:
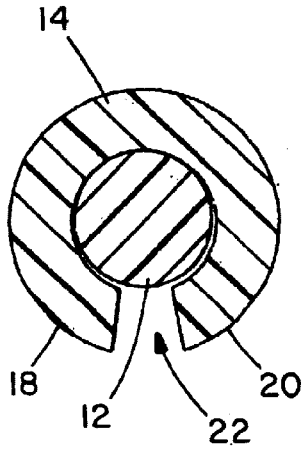
FIG. 5 is a cross-sectional view similar to FIG. 3, after positioning of the label spacer around the cable.

As shown in FIGS. 3–8, label spacer 14 has two opposed arms 18, 20. As best seen in FIG. 4, arms 18, 20 expand to allow label spacer 14 to be positioned substantially circumferentially around cable 12. Moreover, as shown in FIG. 5, arms 18, 20 are disposed so as to provide an opening 22 of sufficient dimension to allow engagement with cable 12 without damaging cable 12.

Figure 6:
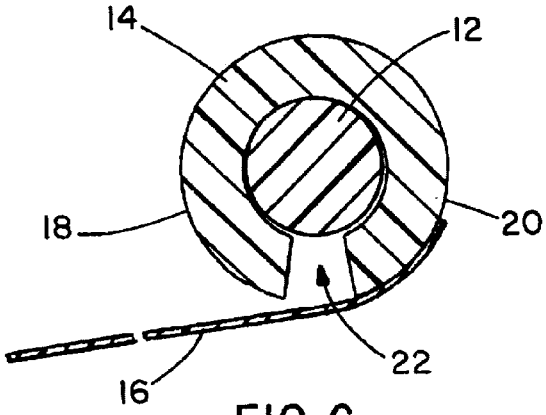
FIG. 6 is a cross-sectional view similar to FIG. 5, as an adhesive label is secured around the label spacer.
Figure 7:
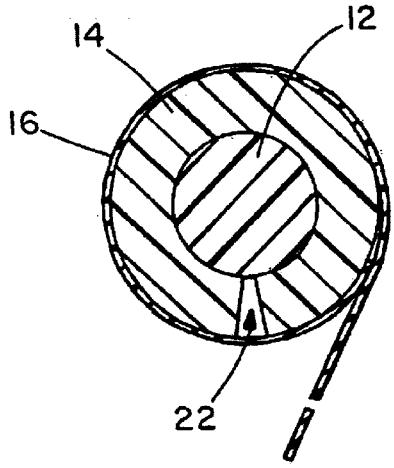
FIG. 7 is a cross-sectional view similar to FIG. 5, after the adhesive label tightens the label spacer around the cable.
Figure 8:
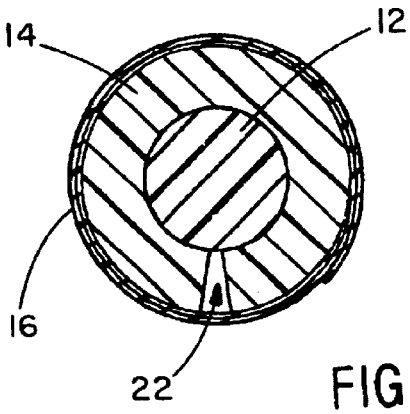
FIG. 8 is a cross-sectional view taken along lines 8—8 of FIG. 1, after the adhesive label tightens the label spacer around the cable.

FIG. 5 shows label spacer 14 in a first, non-compressed position. Conversely, FIGS. 7 and 8 show label spacer 14 in a second, compressed position. As shown in FIGS. 6–8, adhesive label 16 is wrapped circumferentially around label spacer 14 in a manner that forces the ends of opposed arms 18, 20 together, thereby tightening label spacer 14 around cable 12 to secure adhesive label 16 in a substantially permanent manner in a specific location along cable 12. As seen in FIGS. 7 and 8, after adhesive label 16 is wrapped circumferentially around label spacer 14, the ends of arms 18, 20 are in a second, compressed position, and opening 22 is smaller than in FIG. 6.

Figure 9:
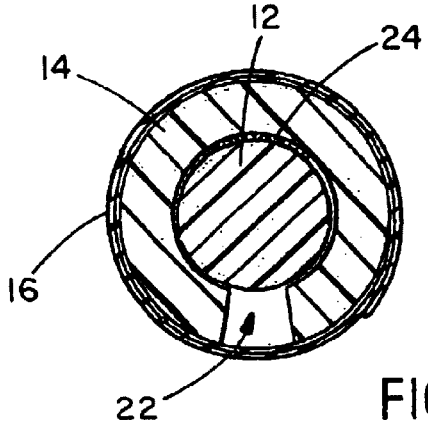
FIG. 9 is a cross-sectional view similar to FIG. 5, showing an adhesive applied on the interior circumferential surface of the label spacer.

The cable identification system shown in FIGS. 1–8 may allow the user to slide or rotate adhesive label 16 for easy viewing without damaging cable 12. However, if more permanent fixation is desired, label spacer 14 can be provided with a pressure sensitive adhesive 24 on the interior circumferential surface of label spacer 14, as shown in FIG. 9, to prevent label spacer 14 from sliding or rotating along cable 12. In either embodiment, label spacer 14 increases the outside diameter of cable 12 so that adhesive label 16 can be easily and properly secured to cable 12, while still being readily viewable.

In operation, label spacer 14 is positioned substantially circumferentially around cable 12, as shown in FIGS. 3–5. As shown in FIGS. 6–8, the user then secures a portion of adhesive label 16 to label spacer 14 and circumferentially wraps adhesive label 16 around label spacer 14, thereby covering opening 22 and tightening label spacer 14 around cable 12 to secure adhesive label 16 in a substantially permanent manner in a specific location along cable 12. If more permanent fixation is desired, the user may apply a pressure sensitive adhesive 24 to the interior circumferential surface of label spacer 14, as shown in FIG. 9, before placing label spacer 14 circumferentially around cable 12. Adhesive 24 will create a stronger engagement between label spacer 14 and cable 12 to prevent label spacer 14 from sliding or rotating along cable 12.

The disclosed invention provides an identification system for easily and properly securing identifying indicia to small diameter fiber optic cables. The cable identification system includes a split sleeve label spacer positionable substantially circumferentially around a cable, and an adhesive label securable circumferentially around the label spacer. It should be noted that the above-described illustrated embodiments and preferred embodiments of the present invention are not an exhaustive listing of the forms such a cable identification system in accordance with the invention might take; rather, they serve as exemplary and illustrative of embodiments of the invention as presently understood. By way of example, and without limitation, a cable identification system having a split sleeve label spacer with a write-on surface is contemplated to be within the scope of the invention. Many other forms of the invention are believed to exist.

What is claimed is:

1. A cable identification system comprising:

a split sleeve label spacer having a perimeter, and being positioned substantially circumferentially around a fiber optic cable; and an adhesive label secured circumferentially around the entire perimeter of the label spacer, the label having indicia on a first side and adhesive at least opposite the indicia on a second side.

2. The cable identification system of claim 1 wherein the label spacer has two opposed arms capable of moving from a first, non-compressed position to a second, compressed position, upon securing the adhesive label circumferentially around the label spacer.

3. The cable identification system of claim 2 including an opening connecting the two opposed arms, the opening allows engagement of the cable in the first position.

4. The cable identification system of claim 1 including a pressure sensitive adhesive appliable to an interior circumferential surface of the label spacer to prevent the label spacer from sliding along the cable.

5. The cable identification system of claim 1 wherein the label spacer is C-shaped and made of plastic.

6. The cable identification system of claim 1 wherein the cable is a two or three millimeter fiber optic cable.

7. A method of securing identifying indicia to small diameter fiber optic cables, the method comprising the steps of:

positioning a split sleeve label spacer having a perimeter substantially circumferentially around a fiber optic cable; and securing an adhesive label circumferentially around the entire perimeter of the label spacer, the label having indicia on a first side and adhesive at least opposite the indicia on a second side.

8. The method of claim 7 wherein the label spacer has two opposed arms capable of moving from a first, non-compressed position to a second, compressed position, upon securing the adhesive label circumferentially around the label spacer.

9. The method of claim 7 further comprising the step of applying a pressure sensitive adhesive to an interior circumferential surface of the label spacer to prevent the label spacer from sliding along the cable.

* * * * *